US008814766B2

(12) United States Patent
Scimone

(10) Patent No.: US 8,814,766 B2
(45) Date of Patent: Aug. 26, 2014

(54) SKIING EXERCISE APPARATUS

(76) Inventor: John A. Scimone, West Farmington, OH (US)

( * ) Notice: Subject to any disclaimer, the term of this patent is extended or adjusted under 35 U.S.C. 154(b) by 418 days.

(21) Appl. No.: 13/226,910

(22) Filed: Sep. 7, 2011

(65) Prior Publication Data

US 2012/0058865 A1 Mar. 8, 2012

Related U.S. Application Data

(60) Provisional application No. 61/402,807, filed on Sep. 7, 2010.

(51) Int. Cl.

| | |
|---|---|
| ***A63B 21/04*** | (2006.01) |
| ***A63B 69/18*** | (2006.01) |
| ***A63B 71/00*** | (2006.01) |
| ***A63B 21/00*** | (2006.01) |
| ***A63B 21/055*** | (2006.01) |
| ***A63B 22/16*** | (2006.01) |
| ***A63B 21/02*** | (2006.01) |
| ***A63B 23/04*** | (2006.01) |

(52) U.S. Cl.

CPC ..... *A63B 21/00069* (2013.01); *A63B 69/18* (2013.01); *A63B 21/0555* (2013.01); *A63B 22/16* (2013.01); *A63B 21/00065* (2013.01); *A63B 21/1492* (2013.01); *A63B 21/023* (2013.01); *A63B 23/0417* (2013.01); *A63B 21/00061* (2013.01); *A63B 21/0414* (2013.01); *A63B 21/00185* (2013.01); *A63B 21/025* (2013.01)

USPC ..... 482/129; 482/51; 482/71

(58) Field of Classification Search

USPC ..... 482/51–53, 66, 70, 71, 121–123, 482/127–130, 133, 134, 142; 434/247, 253

See application file for complete search history.

(56) References Cited

U.S. PATENT DOCUMENTS

| | | | | | |
|---|---|---|---|---|---|
| 3,912,260 | A * | 10/1975 | Rice | 482/4 |
| 4,342,453 | A * | 8/1982 | Wagner | 482/71 |
| 4,396,189 | A * | 8/1983 | Jenkins | 482/71 |
| 5,582,567 | A * | 12/1996 | Chang | 482/146 |
| 5,665,033 | A * | 9/1997 | Palmer | 482/71 |
| 5,792,027 | A * | 8/1998 | Gvoich | 482/51 |
| 5,906,561 | A * | 5/1999 | Lin | 482/52 |
| 6,117,052 | A * | 9/2000 | Frost et al. | 482/52 |
| 6,132,340 | A * | 10/2000 | Wang et al. | 482/54 |
| 6,231,484 | B1 * | 5/2001 | Gordon | 482/71 |
| 6,942,487 | B2 * | 9/2005 | Corbalis | 434/247 |
| 7,097,600 | B2 * | 8/2006 | Gray | 482/71 |
| 7,425,189 | B1 * | 9/2008 | Eschenbach | 482/52 |
| 7,985,168 | B2 * | 7/2011 | Reyes | 482/130 |
| 2003/0119633 | A1 * | 6/2003 | Jacobs et al. | 482/70 |
| 2006/0217234 | A1 * | 9/2006 | Rodgers | 482/52 |
| 2008/0300113 | A1 * | 12/2008 | Battiston | 482/51 |
| 2012/0053019 | A1 * | 3/2012 | Reyes | 482/52 |

* cited by examiner

*Primary Examiner* — Loan H Thanh
*Assistant Examiner* — Gregory Winter

(57) ABSTRACT

An apparatus and method for exercising using an apparatus that includes an upper assembly, equipped with pedal platforms or a snowboard attachment, which is pivotally attached to a lower frame assembly. The lower frame assembly includes ski pole attachments that enable a user to maintain balance while using the apparatus. When the user stands on the pedals, elastic members coupled to the lower frame assembly and the upper frame assembly maintain level of the upper assembly while also providing some resistance to lateral movement. As the user shifts weight to simulate downhill skiing, the resistance by the elastic members, and an adjustable brake component, provide strength and core exercises similar to skiing.

12 Claims, 9 Drawing Sheets

SKIING EXERCISE APPARATUS

CROSS-REFERENCE TO RELATED APPLICATIONS

This application claims priority to U.S. Provisional Patent Application Ser. No. 61/402,807 filed on Sep. 7, 2010 entitled SKIXTREME WORKOUT MACHINE, the disclosure of which, including all materials, CDs, exhibits, figures, photographs, and drawings filed therewith is incorporated by reference herein in its entirety.

BACKGROUND

There has been a proliferation in exercise related devices relating to a variety of sports, including, for example, cycling, cross-country skiing, running, swimming, golf, rowing, and the like. The typical piece of exercise equipment is generally large and heavy, requiring substantial floor space and effort to set up and/or take down. Such exercise equipment, from stair-climbing machines to treadmills to elliptical trainers, all promote forward movement of the legs. That is, such machines simulate actions in which the legs are forced to replicate the natural movement of walking or running.

In contrast, most sports, in addition to requiring forward locomotion, also require the athlete to move laterally. To increase the athlete's ability in lateral (side-to-side) movements, various obstacles and exercise regimes have been developed, e.g., jumping over cones, lateral step exercises, ladders, and the like. Each of these exercises are high-impact activities that place substantial stress on the athlete's leg joints, i.e., hip, knee, ankle, etc. Previous attempts to provide a suitable apparatus have resulted in costly, complex machines that utilize rollers and belts to smoothly simulate skiing, i.e., merely refine skiing technique. Unfortunately, these devices lack any resistance so as to provide strength training. Additionally, the devices further take up a large amount floor space, require a high level of skill prior to use, do not allow crouched/leaned back positioning of the user, allow repetitive stops to a single lateral direction, or the like. Therefore, there remains a need for an exercise device that simulates the lateral motion inherent in athletic activities avoiding the stresses typically placed on joints in such activities, while providing sufficient resistance-based strength training.

BRIEF SUMMARY

In some illustrative embodiments disclosed as illustrative examples herein, an exercise apparatus includes an upper frame assembly, and a lower frame assembly that is operatively coupled to the upper frame assembly at a first lower pivot and a second lower pivot allowing lateral movement of the upper frame assembly relative to the lower frame assembly, with the lower frame assembly having a width greater than a width of the upper frame assembly. The apparatus also includes a first pedal platform that is pivotally attached to the upper frame assembly at a first pivot and a second pivot so as to provide lateral movement relative to the upper frame assembly, and a second pedal platform that is pivotally attached to the upper frame assembly at a first pivot and a second pivot, and which is parallel to the first pedal platform so as to provide lateral movement relative to the upper frame assembly. In addition, the apparatus includes a plurality of elastic members that are operatively coupled to the upper frame assembly and the lower frame assembly so as to provide resistance and stability of the upper frame assembly relative to the lower frame assembly.

In some illustrative embodiments disclosed as illustrative examples herein, a skiing exercise apparatus includes an upper frame assembly that comprises a first cross member, a second cross member, a first side member, a second side member, a third side member, a fourth side member, a first vertical member, a second vertical member, and center member that is perpendicularly coupled to the first vertical member and the second vertical member. The skiing apparatus also includes a lower frame assembly that is operatively coupled to the first vertical member and the second vertical member of the upper frame assembly at a first lower pivot and a second lower pivot allowing lateral movement of the upper frame assembly relative to the lower frame assembly, wherein the lower frame assembly having a width greater than a width of the upper frame assembly. In addition, the skiing exercise apparatus includes a first pedal platform that is pivotally attached to the first side member and the second side member of the upper frame assembly at a first pivot and a second pivot so as to provide lateral movement relative to the upper frame assembly. The skiing exercise apparatus further includes a second pedal platform that is pivotally attached to the third side member and the fourth side member of the upper frame assembly at a first pivot and a second pivot and parallel to the first pedal platform so as to provide lateral movement relative to the upper frame assembly. Additionally, the skiing exercise apparatus includes a plurality of elastic members that are operatively coupled to the center member of the upper frame assembly and a first side member and a second side member of the lower frame assembly so as to provide resistance and stability of the upper frame assembly relative to the lower frame assembly.

In some illustrative embodiments disclosed as illustrative examples herein a method for operating a skiing apparatus, includes positioning an equal amount of weight on a first pedal platform and a second pedal platform pivotally attached to an upper assembly that simulate the direction and level of actual skis. The method also includes applying a balancing force to a first pole attachment and a second pole attachment operatively coupled to a lower frame assembly pivotally attached to the upper frame assembly. In addition, the method includes shifting the weight on the first pedal platform and the second pedal platform alternatively in each direction laterally relative to the lower frame assembly so as to rotate the upper frame assembly relative thereto so as to simulate a lateral motion of downhill skiing.

BRIEF DESCRIPTION OF THE FIGURES

The present disclosure may take form in certain parts and arrangements of parts, several embodiments of which will be described in detail in this specification and illustrated in the accompanying drawings which form a part hereof and wherein.

DETAILED DESCRIPTION

It is to be understood that the detailed figures are for purposes of illustrating exemplary embodiments of the present disclosure only and are not intended to be limiting. Additionally, it will be appreciated that the drawings are not to scale and that portions of certain elements may be exaggerated for the purpose of clarity and ease of illustration.

Figure 7:
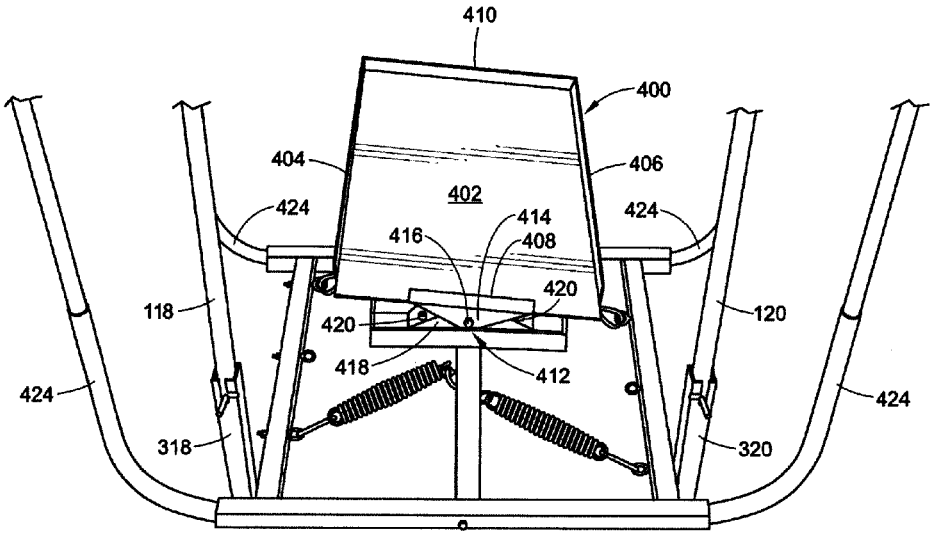
FIG. 7 is a front view of a snowboard assembly of the exercise apparatus in accordance with one embodiment of the subject application.
Figure 8:
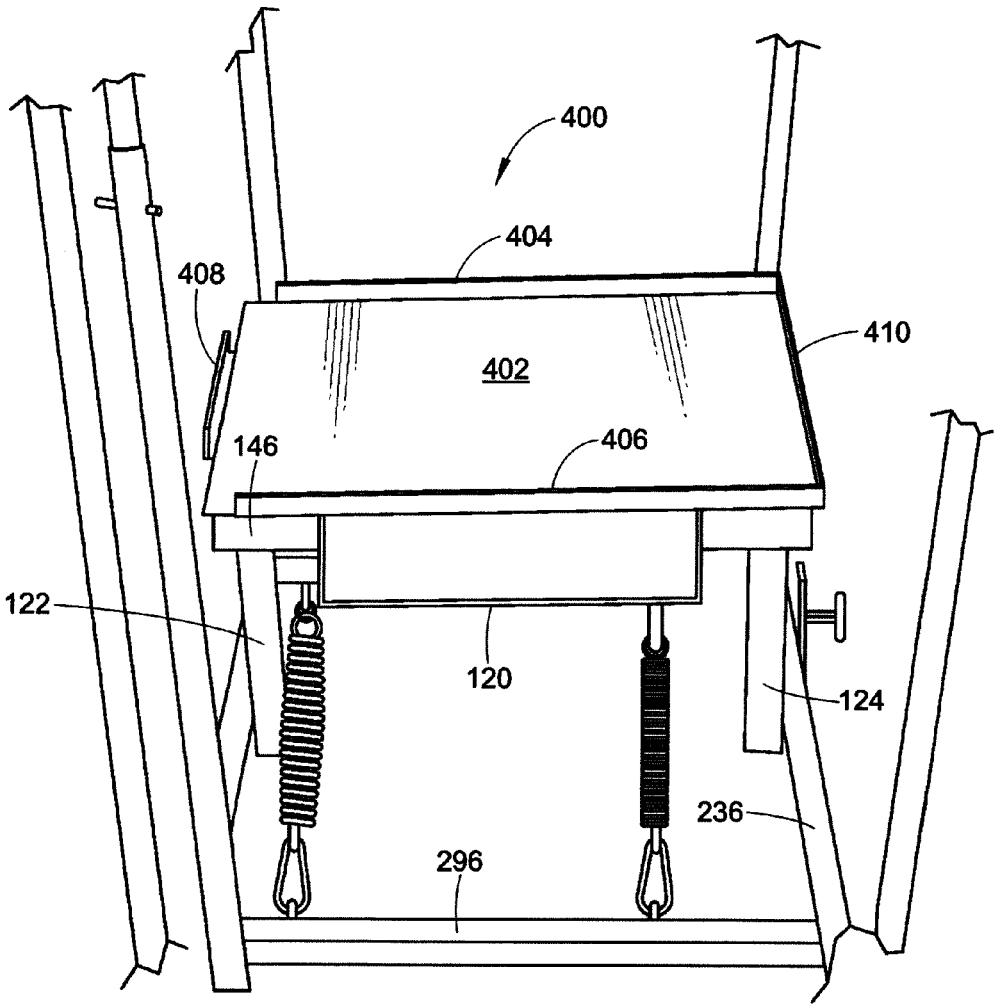
FIG. 8 is a side view of the snowboard assembly of the exercise apparatus in accordance with one embodiment of the subject application.
Figure 9:
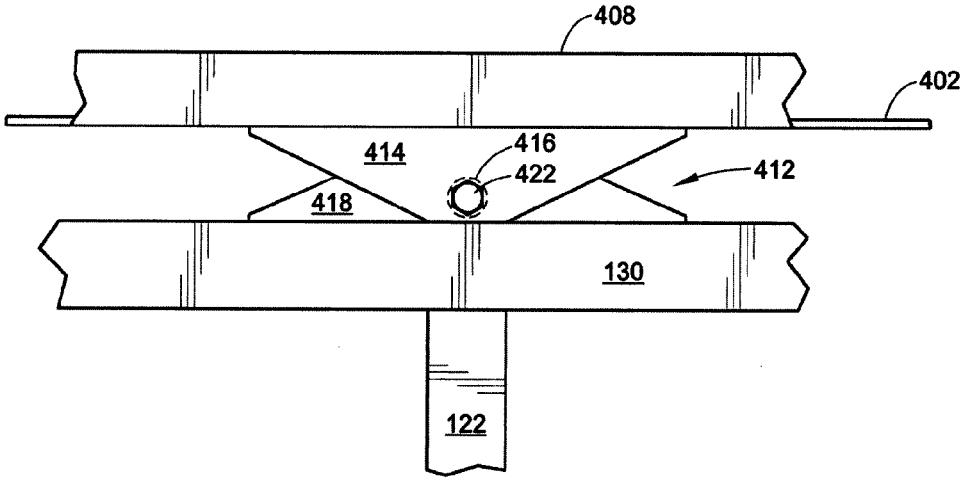
FIG. 9 is an enlarged view of a board pivot of the snowboard assembly of the exercise apparatus in accordance with one embodiment of the subject application.

According to one embodiment, an exercise device 100 includes an upper frame assembly 102 and a lower frame assembly 104. The exercise device 100 also includes a first pedal platform 110, a second pedal platform 112, a plurality of elastic members 114, and a brake component 116. In yet other embodiments, the exercise device 100 includes a set of poles 118 and 120 removably coupled to the lower frame assembly 104. In some embodiments, the exercise device 100 includes a snowboard assembly 400 and cage assembly 424 (as shown in FIG. 7-9). It will be appreciated that while illustrated in FIGS. 1-9 as square tubing, the various frame components and associated members may be tubular, beams, or the like, and include various caps, covers, stoppers, or other protective measures.

In accordance with one embodiment contemplated herein, the upper frame assembly 102 is operatively coupled to the lower frame assembly 104 via a first vertical member 122 at a first lower pivot joint 106 and via a second vertical member 124 at a second lower pivot joint 108. The first and second lower pivot joints 106 and 108 may be located at a centerline of the lower frame assembly 104 as illustrated in FIGS. 1-6B. It will be appreciated that suitable pivot joints 106 and 108 allow the upper frame assembly 102 to move in a lateral direction about a first axis 126 with respect to the stationary lower frame assembly 104.

The upper frame assembly 102, according to one embodiment, includes a first cross member 130 and an oppositely disposed second cross member 132. In one embodiment, the first cross member 130 is oriented generally parallel to the second cross member 132. The first vertical member 122 of the upper frame assembly 102 is perpendicularly coupled to a center of the first cross member 130 and the second vertical member 124 is perpendicularly coupled to a center of the second cross member 132. It will be appreciated that any suitable means of coupling are capable of implementation herein to couple the vertical members 122 and 124 to the respective cross members 130 and 132 including, for example and without limitation, fasteners, welds, interlocking components, friction attachments, and the like. The first and second vertical members 122 and 124 extend outwardly from respective first and second cross members 130 and 132 in a direction toward the lower frame assembly 104. In one embodiment, the first vertical member 122 includes a pivot hole 134 located at end 136 opposite the end 138 coupled to the first cross member 130 and extending therethrough in the direction of the first axis 126. The second vertical member 124 includes a pivot hole 140 located at an end 142 opposite the end 144 coupled to the second cross member 132 and extending therethrough in the direction of the first axis 126. The second vertical member 124 further includes attachment points 264 and 266 for affixing of the brake component 116 as described in greater detail below.

The upper frame assembly 102 further includes a center member 146 having a first side 147*a*, a second side 147*b* opposite the first side 147*a*, a first end 148, and an opposite second end 150. The center member 146 extends between the first vertical member 122 and the second vertical member 124 and coupled thereto, respectively at the first end 148 and the second end 150. It will be appreciated that any suitable means of coupling are capable of implementation herein to couple the first end 148 of the center member 146 to the first vertical member 122 and the second end 150 of the center member 146 to the second vertical member 124 including, for example and without limitation, fasteners, welds, interlocking components, friction attachments, and the like.

Figure 2:
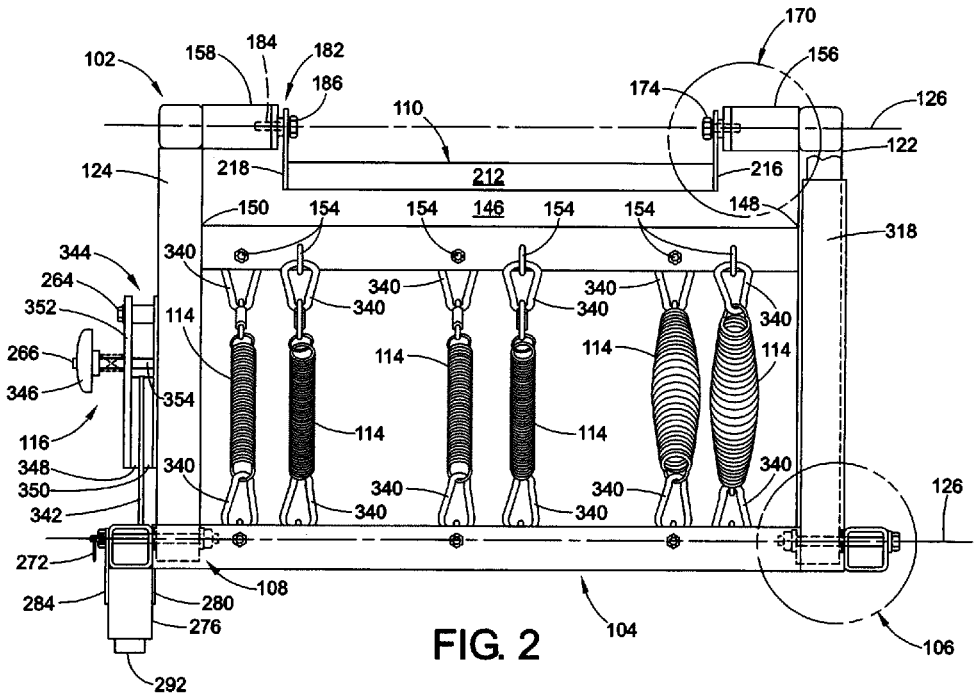
FIG. 2 is an enlarged side view of the exercise apparatus in accordance with one embodiment of the subject application.
Figure 3:
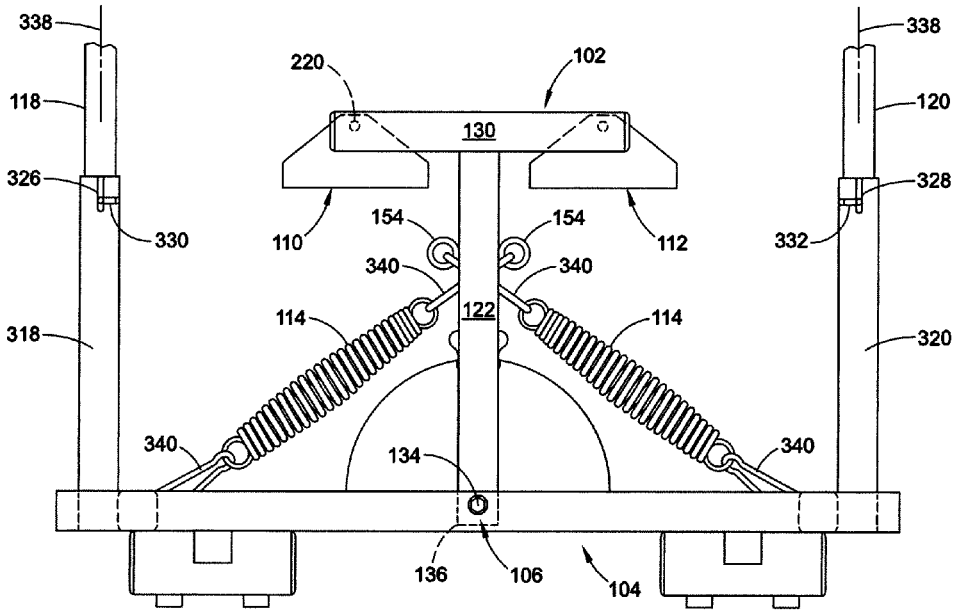
FIG. 3 is a front enlarged view of the exercise apparatus in accordance with one embodiment of the subject application.
Figure 5:
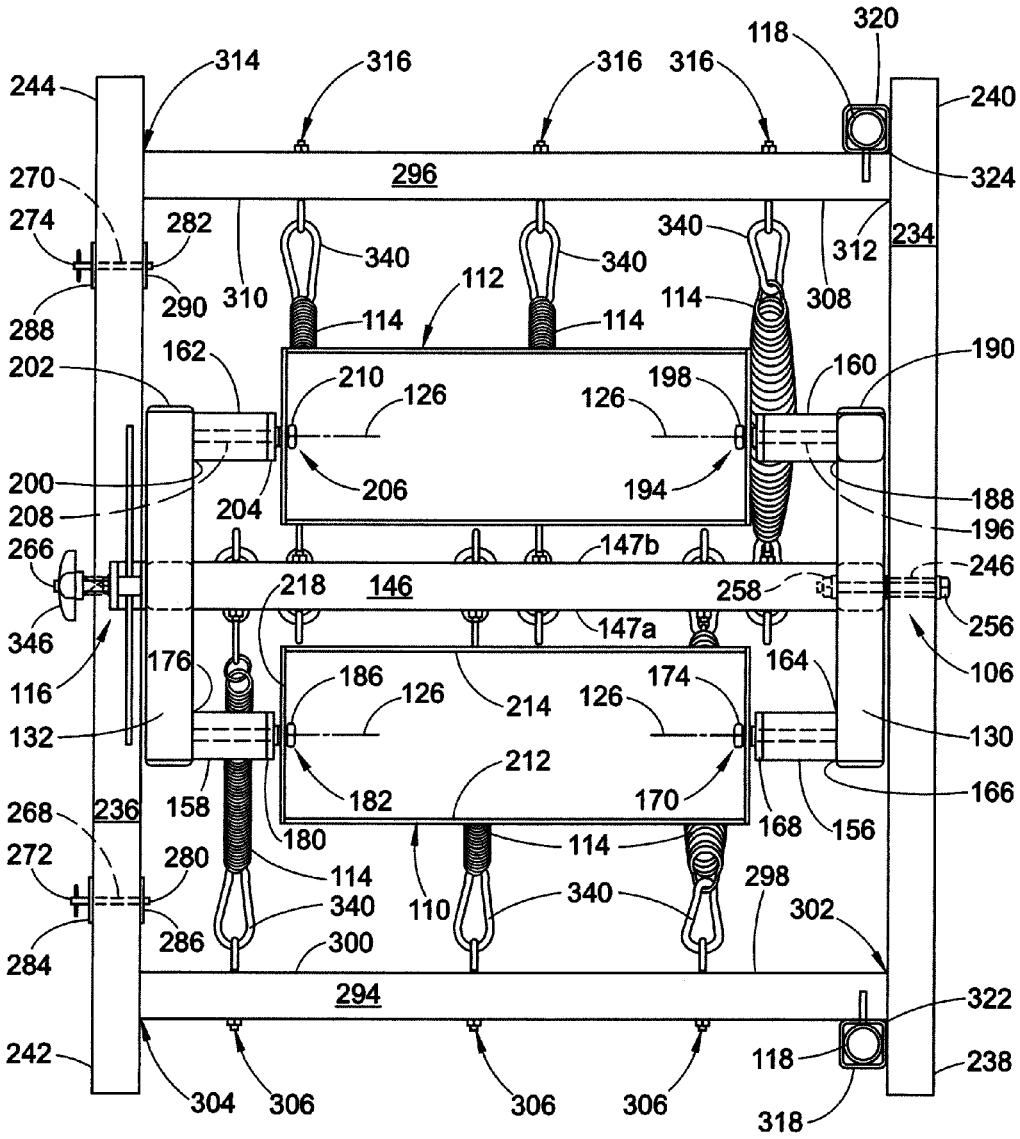
FIG. 5 is a top enlarged view of the exercise apparatus in accordance with one embodiment of the subject application.

According to one embodiment of the subject application, the center member 146 is positioned above a center 152 of the first vertical member 122 and the second vertical member 124. As illustrated in FIGS. 2 and 5, the center member 146 is coupled to the first vertical member 122 and the second vertical member 124 below the first pedal platform 110 and the second pedal platform 112. The center member 146 further includes a plurality of attachment points 154 capable of coupling one end of the elastic members 114, as discussed in greater detail below. In one embodiment, the center member 146 includes an equal number of attachment points on each side thereof. In such an embodiment, the attachment points 154 on each side are offset relative to the attachment points 154 of the opposing side. The attachment points 154 may be eye-bolts extending through the center member 146 and coupled thereto with washers and nuts (not shown), hooks, spring-loaded clips, chain-links, or other attachment points as will be appreciated. In other embodiments, the attachment points 154 may be permanently affixed to the center member 146 via welding or other suitable permanent affixing means, as will be appreciated.

The upper frame assembly 102 also includes a first side member 156 having a first end 164 that is perpendicularly coupled to a first end 166 of the first cross member 130 and which has an opposite end 168 coupled to the first pedal platform 110 at a first pedal pivot joint 170. It will be appreciated that any suitable means of coupling are capable of implementation herein to couple the first side member 156 to the first cross member 130 including, for example and without limitation, fasteners, welds, interlocking components, friction attachments, and the like. The first side member 156 further includes a pivot hole 172 located at the opposite end 168 and extending through the first side member 156. In one embodiment, the pivot hole 172 extends into the first cross member 130 so as to receive a bolt 174 as discussed below.

The upper frame assembly 102 further includes a second side member 158 having a first end 176 that is perpendicularly coupled to a first end 178 of the second cross member 132 and which has an opposite end 180 coupled to the first pedal platform 110 at a second pedal pivot joint 182. It will be appreciated that any suitable means of coupling are capable of implementation herein to couple the second side member 158 to the second cross member 132 including, for example and without limitation, fasteners, welds, interlocking components, friction attachments, and the like. The second side member 158 further includes a pivot hole 184 located at the opposite end 180 and extending through the second side member 158. According to one embodiment, the pivot hole 184 extends through the second cross member 132 so as to receive a bolt 186 as discussed below. In one embodiment, the first side member 156 and the second side member 158 are generally aligned along a common horizontal plane corresponding to the upper frame assembly 102.

The upper frame assembly 102 further comprises a third side member 160 having a first end 188 that is perpendicularly coupled to a second end 190 of the first cross member 130 and which has an opposite end 192 coupled to the second pedal platform 112 at a first pedal pivot joint 194. It will be appreciated that any suitable means of coupling are capable of implementation herein to couple the third side member 160 to the first cross member 130 including, for example and without limitation, fasteners, welds, interlocking components, friction attachments, and the like. The third side member 160 further includes a pivot hole 196 located at the opposite end 192 and extending through the third side member 160. In one embodiment, the pivot hole 192 is extended into the first cross member 130 so as to receive a bolt 198 as discussed below.

The upper frame assembly 102 also includes a fourth side member 162 having a first end 200 that is perpendicularly coupled to a second end 202 of the second cross member 132 and which has an opposite end 204 coupled to the second pedal platform 112 at a second pedal pivot joint 206. It will be appreciated that any suitable means of coupling are capable of implementation herein to couple the fourth side member 162 to the second cross member 132 including, for example and without limitation, fasteners, welds, interlocking components, friction attachments, and the like. The fourth side member 162 further includes a pivot hole 208 located at the opposite end 204 and extending through the fourth side member 162. According to one embodiment, the pivot hole 208 is extended into the second cross member 132 so as to receive a bolt 210 as discussed below. In one embodiment, the third side member 160 and the fourth side member 162 are generally aligned along a common horizontal plane corresponding to the upper frame assembly 102 and are parallel to the first side member 156 and the second side member 158.

The first and second pedal platforms 110 and 112 can include the same components and only the first pedal platform 110 will be discussed in detail. The first pedal platform 110 of the upper frame assembly 102 is pivotally attached to the upper frame assembly 102 at the first pedal pivot joint 170 and the second pedal pivot joint 182, so as to enable lateral movement about the first axis 126 extending through the first and second pedal pivot joints 170 and 182 of the first pedal platform 110 relative to the upper frame assembly 102. As illustrated in FIG. 5, the first pedal platform 110 is embodied as a substantially rectangular platform having raised, opposed side portions 212 and 214, a raised front portion 216, and a raised back portion 218. The front and back portions 216 and 218 respectively include a first pivot hole 220 and a second pivot hole 222 so as to allow connectivity at the first pedal pivot joint 170 and the second pedal pivot joint 182. According to one embodiment, the front and back portions 216 and 218 are of height that is greater than the height of the corresponding side portions 212-214. The first pivot hole 220 and the second pivot hole 222 are suitably located at an apex of the corresponding front and back portions 216 and 218 such that the top of the first pedal platform 110 rests below a respective top of the upper platform assembly 102. Coupling of the first pedal platform 110 is described hereinafter at the first and second pedal pivot joints 170 and 182 of the first pedal platform 110. In accordance with one embodiment of the subject application, the first pedal platform 110 may include a non-slip material (not shown) placed on a flat upper surface thereof so as to prevent sliding of a user during usage of the exercise device 100.

Figure 6A:
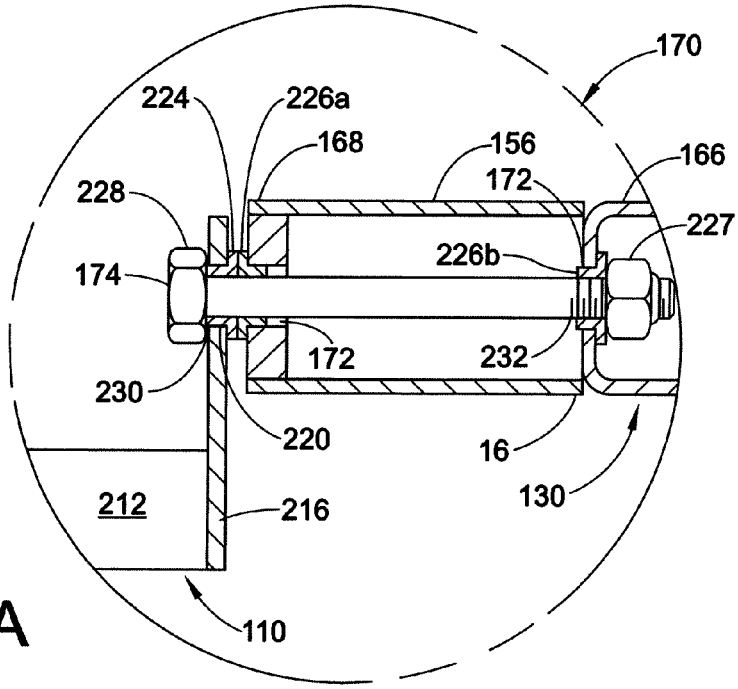
FIG. 6A is an enlarged view of a pedal pivot of the exercise apparatus in accordance with one embodiment of the subject application.

An expanded view of the components of the pedal pivot joint 170 is illustrated in FIG. 6A. The pedal pivot joints 170 and 182 of the first pedal platform 110 and the pedal pivot joints 194 and 206 of the second pedal platform 112 can include the same components and only the first pedal pivot joint 170 will be discussed in detail. The first pedal pivot joint 170 of the first pedal platform 110 of the upper frame assembly 102 includes the first pivot hole 220 in the front portion 216 of the first pedal platform 110 that is adapted to receive a first bushing 224 and the first pivot hole 172 located in the opposite end 168 of the first side member 156 and extending therethrough into the first cross member 130 that is adapted to receive a second bushing 226*a*, a third bushing 226*b* and to threadably receive the first pivot bolt 174 via a first pivot bolt nut 227. The first bushing 224, the second bushing 226*a*, and the third bushing 226*b* are oriented and configured to rotatably support the first pivot bolt 174 axially inserted therethrough. The first pivot bolt 174 has a distal portion 228 with a radial edge 230 that abuts the first bushing 224 and an oppositely disposed proximal threaded portion 232 that is axially inserted through the first bushing 224, the second bushing 226*a*, and the third bushing 226*b* of the first pedal pivot joint 170 to threadably engage the pivot nut 227 via the pivot hole 172 of the first side member 156 inside the first cross member 130, as illustrated in FIG. 6A.

It will thus be appreciated that the first pedal platform 110 is thereby suitably enabled to rotate about the first axis 126 around the first pivot joint 170 and the second pedal pivot joint 182. Similarly, the second pedal platform 112 is thereby suitably enabled to rotate about the first axis 126 around the first pivot joint 194 of the second pedal platform 112 and the second pivot joint 206. It will also be appreciated that while described herein as using bushings at the pivot joints 170, 182, 194, and 206, any suitable rotating means may be used in accordance with the subject application including, for example and without limitation, nylon bushings, brass bushings, bearings, pins, ball bearings, and the like.

According to one embodiment of the subject application, the lower frame assembly 104 comprises a first cross member 234 and an oppositely opposed a second cross member 236. In such an embodiment, the first cross member 234 is oriented generally parallel to the second cross member 236, with the first and second cross members 234 and 236 laying on the same plane. As illustrated in FIG. 5, the first cross member 234 and the second cross member 236 are substantially the same length so as to provide stability thereof in supporting the upper frame assembly 102. The first cross member 234 includes a first end 238 and an opposite second end 240, and the second cross member 236 includes a first end 242 and an opposite second end 244. It will be appreciated that while illustrated as having substantially the same length, the first and second cross members 234 and 236 may be of differing lengths.

Figure 6B:
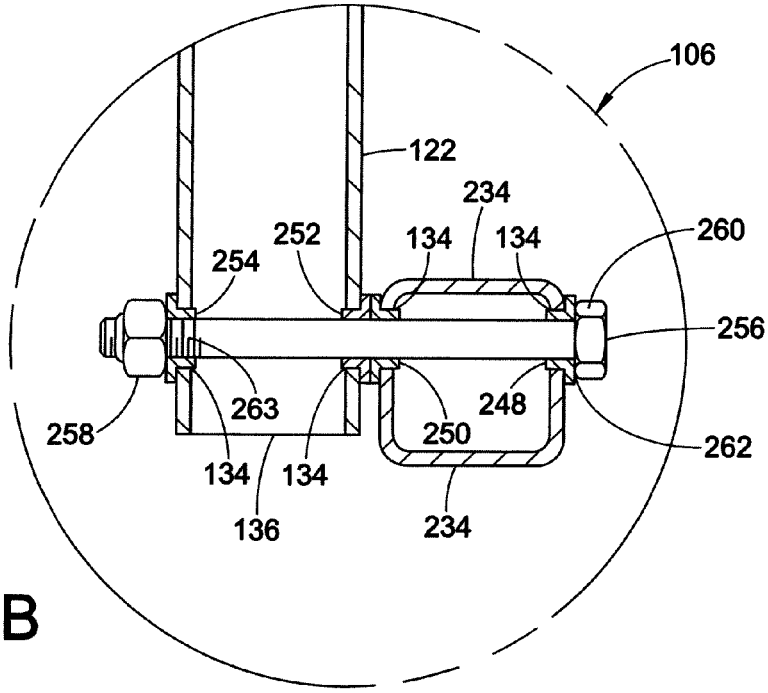
FIG. 6B is an enlarged view of a lower pivot of the exercise apparatus in accordance with one embodiment of the subject application.

The first cross member 234 includes the first lower pivot joint 106 located approximately at the center of the cross member 234. The first lower pivot joint 106 and the second lower pivot joint 108 can include same components and only the first lower pivot point 106 will be discussed in detail. FIG. 6B illustrates an enlarged view of the components of the first pivot joint 106. The first lower pivot joint 106 includes the first pivot hole 134 of the first vertical member 122 extending perpendicularly therethrough, a first cross member pivot hole 246 extending perpendicularly through the first cross member 234, a first cross member bushing 248 extending into the first cross member pivot hole 246, a second cross member bushing 250 extending into the first cross member pivot hole 246, a first vertical member bushing 252 extending into the first vertical member 122, a second vertical member bushing 254, a first pivot bolt 256, and a first pivot nut 258. The bushings 248-254 are oriented and configured to rotatably support the first pivot bolt 256 axially inserted therethrough. The first pivot bolt 256 has a distal portion 260 with a radial edge 262 that abuts the first cross member bushing 248 and an oppositely disposed proximal threaded portion 263 that is axially inserted through the first cross member bushing 248, the second cross member bushing 250, the first vertical member bushing 252, and the second vertical member bushing 254, so as to threadably engage the first pivot nut 258 thereby rotatably securing the first vertical member 122 to the first cross member 234.

The second cross member 236 includes the second lower pivot joint 108 located approximately at a center point of the second cross member 236. Thus, as explained in detail above with respect to the first cross member 234 and the first vertical member 122, the second lower pivot joint 108 is operative with respect to the second vertical member 124 and the second cross member 236. It will be appreciated that the first lower pivot joint 106 and the second lower pivot joint 108 cooperatively enable rotation of the upper frame assembly 102 about the first axis 126 relative to the lower frame assembly 104. Thus, the lower frame assembly 104 remains stationary while upper frame assembly 102 pivots right and left relative to the cross members 234 and 236 of the lower frame assembly 104.

Figure 4:
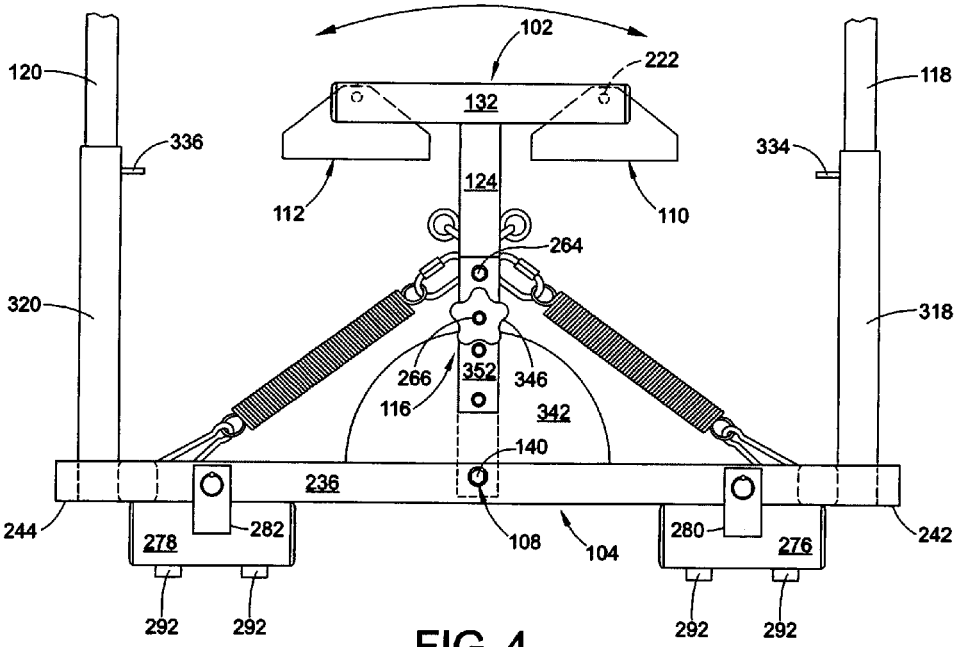
FIG. 4 is a rear enlarged view of the exercise apparatus in accordance with one embodiment of the subject application.

In one embodiment, the lower frame assembly 104 includes holes 268 and 270 located on the second cross member 236 near the opposing first and second ends 242 and 244. In such an embodiment, the holes 268 and 270 extend perpendicularly through the second cross member 236 and are configured to receive a respect first pin 272 and second pin 274, so as to respectively couple angle adjustment components 276 and 278 to the underside of the second cross member 236, as illustrated in FIG. 4. It will be appreciated that the angle adjustment components 276 and 278 are configured to raise the second cross member 236 above the first cross member 234 so as to simulate a down-hill slope on the exercise device 100. It will further be appreciated that various angle adjustment components 276 and 278 may be used to increase the downward slope angle of the exercise device 100. In the embodiment depicted in FIG. 4, the angle adjustment components 276 and 278 are comprised of rectangular blocks having upper brackets 280 and 282 for surrounding the sides of the second cross member 236. These upper brackets 280 and 282 includes holes 284, 286, 288, and 290 on opposing sides thereof, enabling the first and second pins 272 and 274 to extend through the brackets 280 and 282 and the second cross member 236 so as to removably affix the angle adjustment components 276 and 278 thereto. In the embodiment illustrated in FIG. 4, the angle adjustment components 276 and 278 include a plurality of pads 292 affixed to a bottom thereof so as to prevent movement of the exercise device 100 during use, to increase height of the angle adjustment components 276 and 278, and the like.

The lower frame assembly 104, according to one embodiment, also includes a first side member 294 and an oppositely opposed second side member 296. In one embodiment, the first side member 294 is oriented generally parallel to the second side member 296, with the first and second side members 294 and 296 laying on the same plane as the first cross member 234 and the second cross member 236. The first side member 294 includes a first end 298 and an opposite second end 300, wherein the first end 298 is suitably perpendicularly coupled to the first cross member 234 at a first joint 302 proximally inset from the first end 238 of the first cross member 234. The second end 300 of the first side member 294 is also suitably perpendicularly affixed to the second cross member 236 at a second joint 304 proximally inset to the first end 242 of the second cross member 236. It will be appreciated that the first side member 294 may be coupled to the first cross member 234 and the second cross member 236 via any suitable attachment means including, for example and without limitation, fasteners, welds, interlocking components, friction attachments, and the like. It will also be appreciated that while depicted in FIG. 5 as being inset from first ends 238 and 242 of the first and second cross members 234 and 236, coupling of the first side member 294 to the first and second cross members 234 and 236 may be located at the respective first ends 238 and 242 thereof, outside the respective ends 238 and 242, or the like.

The first side member 294 further includes a plurality of attachment points 306 facing inward toward the second side member 296 that are capable of coupling one end of the elastic members 114, as discussed in greater detail below. In one embodiment, the first side member 294 includes a number of attachment points 306 equal to a number of attachment points 154 on the side of the center member 146 facing the first side member 294, or one-half the total number of attachment points 154 on the center member 146. The attachment points 306 may be eye-bolts extending through the first side member 294 and coupled thereto with washers and nuts, hooks, spring-loaded clips, chain-links, or other attachment points as will be appreciated. It will be appreciated that other embodiments include the attachment points 306 permanently affixed to the first side member 294 via welding or other suitable permanent affixing means.

The second side member 296 includes a first end 308 and an opposite second end 310, wherein the first end 308 is suitably perpendicularly coupled to the first cross member 234 at a first joint 312 proximally inset from the second end 240 of the first cross member 234. The second end 310 of the second side member 296 is also suitably perpendicularly affixed to the second cross member 236 at a second joint 314 proximally inset to the second end 244 of the second cross member 236. It will be appreciated that the second side member 296 may be coupled to the first cross member 234 and the second cross member 236 via any suitable attachment means including, for example and without limitation, fasteners, welds, interlocking components, friction attachments, and the like. It will also be appreciated that while depicted in FIG. 5 as being inset from second ends 240 and 244 of the first and second cross members 234 and 236, coupling of the second side member 296 to the first and second cross members 234 and 236 may be located at the respective second ends 240 and 244 thereof, outside the respective second ends 240 and 244, or the like.

The second side member 296 also includes a plurality of attachment points 316 that face inward towards the first side member 294, which are capable of attaching to one end of the elastic members 114, as discussed in greater detail below. In one embodiment, the second side member 296 also includes a number of attachment points 316 equal to a number of attachment points 154 on the side of the center member 146 facing the second side member 296, or one-half the total number of attachment points 154 on the center member 146. In accordance with one embodiment of the subject application, the attachment points 316 of the second side member 296 are implemented as eye-bolts extending through the second side member 296 and coupled thereto with washers and nuts. According to additional embodiments, the attachment points 316 of the second side member may be implemented as hooks, spring-loaded clips, chain-links, or other suitable attachment means. It will be appreciated that still other embodiments include the attachment points 316 permanently affixed to the second side member 296 via welding, formed attachment means, or other suitable permanent affixing means.

The lower frame assembly 104 further includes a first post 318 and a second post 320, located at opposite ends 240 and 242 of the first cross member 234 and extending in a direction perpendicularly upwards therefrom. According to one embodiment of the subject application, the first post 318 is coupled to the first cross member 234 and the first side member 294 at the joint 322 via suitable attachment means including, for example and without limitation, fasteners, welds, interlocking components, friction attachments, and the like. In such an embodiment, the second post 320 is coupled to the first cross member 234 and the second side member 296 at the joint 324 via suitable attachment means including, for example and without limitation, fasteners, welds, interlocking components, friction attachments, and the like. According to one embodiment, the first and second posts 318 and 320 are of a hollow, tubular construction and configured to receive a corresponding first ski pole attachment 118 and a second ski pole attachment 120. The first and second posts 318 and 320 further include vertical slots 326 and 328, and associated horizontal slots 330 and 332. The ski pole attachments 118 and 120 include pins 334 and 336 that are perpendicularly affixed a predetermined length from a respective lower ends (not shown) of the attachments 118 and 120. In such and embodiment, the pins 334 and 336 slideably engage the vertical slots 326 and 328 during insertion of the attachments into the hollow posts 318 and 320. Upon application of a rotation about a second axis 338, the pins 334 and 336 slideably engage the horizontal slots 330 and 332 so as to lock the pole attachments 118 and 120 respectively into the posts 318 and 320 during usage of the exercise device 100.

Removably coupled to the plurality of attachment points 154 of the center member 146 of the upper frame assembly 102 and the attachment points 306 and 316 of the first and second side members 294 and 296 of the lower frame assembly 104 are a plurality of elastic members 114. It will be appreciated that such elastic members 114 may be suitably configured to provide tension so as to maintain the position of the upper frame assembly 102 vertically relative to the lower frame assembly 104 absent application of a lateral force applied via the pedal platforms 110 and 112. An elastic member as used herein includes any device that stretches or compresses in response to a sufficient force, and after removal of such force, returns to its original position and/or shape. As contemplated and used herein, suitable elastic members 114 may include, for example and without limitation, springs, rubber bands, pulleys, fluid-based mechanisms (pistons, resistance devices, etc.), friction-based resistance devices, or other like mechanical, fluid, electric, or electro-mechanical devices. According to one embodiment, the elastic members 114 are removably coupled to the attachment points 154 of the center member 146 and the attachment points 306 and 316 of the first and second side members 294 and 296 via a plurality of retaining clips 340.

As illustrated in FIGS. 1-9, the elastic members 114 coupled to the first side member 294 at attachment points 306 are coupled to the attachment points 154 on the center member 146 on the side 147*b* that faces the second side member 296. Similarly, the elastic members 114 coupled to the second side member 296 at attachment points 316 are coupled to the attachment points 154 on the center member 146 on the side 147*a* that faces the first side member 294. That is, the elastic members 114 cross under the center member 146 to attach to the attachment points 154 on the side 147*b* or 147*a* opposite the side facing the respective first or second side member 294 or 296. In such an embodiment, the retaining clips 340 are spring loaded carabiners suitably capable of supporting a preselected amount of tension placed thereon. It will be appreciated that other methods of coupling the elastic members 114 to the attachment points 154, 306, and 316 may be used in accordance with the subject application, including, for example and without limitation, hooks, locking carabiners, locking clamps, chain links, or the like.

According to varying embodiments of the subject application, the elastic members 114 may be interchanged in accordance with the weight or strength of an associated user. For example, when a lighter individual uses the device 100, the number of elastic members 114 attached thereto may be reduced, as the force needed to maintain an upright position of the upper frame assembly 102 relative to the lower frame assembly 104, or to rotate the upper frame assembly 102 relative to the lower frame assembly 104 would be less than that required for a heavier individual. According to another embodiment, the elastic members 114 may all be of a uniform size and performance, or a combination of different sizes and performances may be implemented. For example, when the elastic members 114 are bands, springs, pulleys, fluid based, etc., each member 114 may offer the same amount of resistance (e.g., 100 lbs to 200 lbs), a mixture (pairs of 100-200 lbs and pairs of 200-300 lbs), or the like.

The lower frame assembly 104 further includes a brake component 116 that includes a semi-circular plate member 342 operatively coupled to the second cross member 236 of the lower frame assembly 104, a brake pad assembly 344 coupled to the second vertical member 124 to frictionally engage the semicircular plate member 342, and a tension adjusting member 346 configured to increase the amount of friction applied to the plate member 342, thereby increasing or decreasing resistance during pivoting of the upper frame assembly 102 relative to the lower frame assembly 104. It will be appreciated that the semicircular plate member 342 may be removably attached to the second cross member 236 of the lower frame assembly 104 via common bolts, via weld, or other fastening mechanisms. In accordance with one embodiment, the brake pad assembly 344 includes a first brake pad 348 and an opposite second brake pad 350 in a brake pad bracket 352. In such an embodiment, the tension adjustment member 346 is implemented as a screw-type adjuster, engaging a threaded component 354 on the brake pad bracket 352 such that rotation of the tension adjustment member 346 decreases the distance between the pads 348, 350 and the plate 342 so as to increase resistance, and vice versa to decrease resistance.

Figure 1:
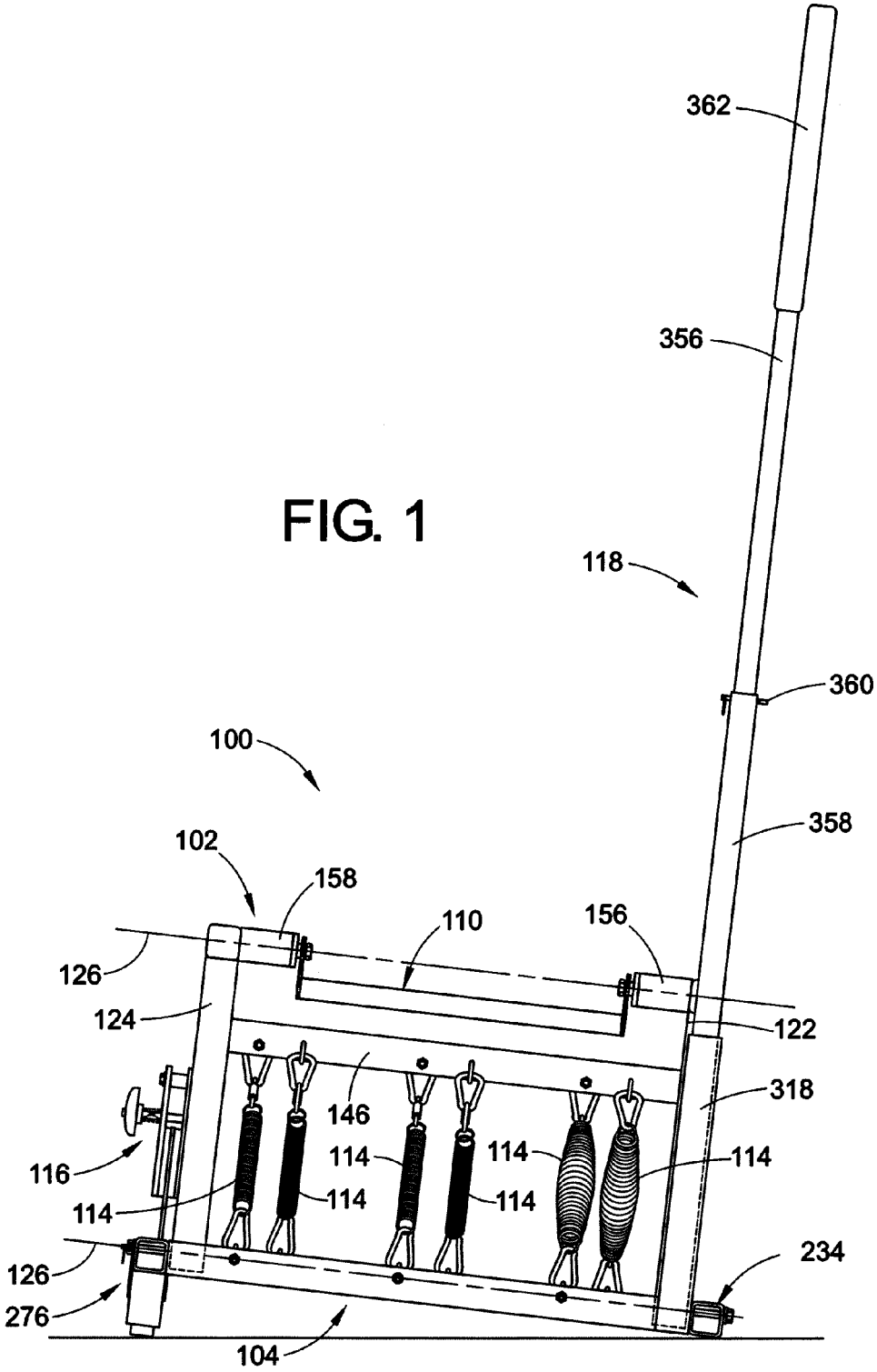
FIG. 1 is side view of an exercise apparatus in accordance with one embodiment of the subject application.

The ski pole attachments 118 and 120 illustrated, for example in FIG. 1, are tubular, extendable poles perpendicular relative to the first and second cross members 234 and 236 of the lower frame assembly 104. In one embodiment, the attachments 118 and 120 are of a sufficient diameter so as to fit inside the hollow posts 318 and 320 of the lower frame assembly 104. The ski pole attachments 118 and 120 can include the same components and only the first ski pole attachment 118 will be discussed in detail. Accordingly, the ski pole attachment 118 includes an upper component 356 and a lower component 358, wherein the upper component 356 has a diameter smaller than the diameter of the lower component 358, thereby enabling the upper component 356 to be slideably inserted into the lower component 358. It will be appreciated that the upper component 356 may be tapered such that a portion of the upper component 356 has a diameter that is equal to or greater than the inner diameter of the lower component 358, thereby preventing the upper component 356 from fully descending into the lower component 358. According to one embodiment, the upper and lower components 356 and 358 may include a plurality of adjustment holes (not shown) extending longitudinally therealong, wherein a pin 360 is inserted into aligned adjustment holes so as to adjust the height of the ski pole attachment 118 (or 120).

In some embodiments of the subject application, the ski pole attachment 118 includes a grip or a handle 362. The grip 362 may comprise tape, foam, rubber, or other suitable gripping materials, as will be appreciated. According to such an embodiment, color-coding (not shown) may be used to illustrate various hand positions to simulate varying skiing positions, e.g., green, red, yellow, black, blue, or the like, each of which may pertain to a different level of intensity or difficulty associated with usage of the exercise device 100.

Referring now to FIGS. 7-9, there are illustrated varying views of another embodiment of the subject application employing a snowboard assembly 400 operatively coupled to the upper frame assembly 102. In accordance such an embodiment, the snowboard assembly 400 is capable of being removably affixed to the upper frame assembly 102 so as to provide training to a user similar to snowboarding. As shown in FIGS. 7-9, the snowboard assembly 400 includes a platform 402 substantially rectangular in shape, having a first raised side 404 parallel with the first and second side members 156 and 158 of the upper assembly 102, and a second raised side 406 parallel with the third and fourth side members 160 and 162 of the upper assembly 102. The snowboard assembly 400 further includes a front raised portion 408 and an opposite raised rear portion 410. The snowboard assembly 400 is removably coupled to the first cross member 130 of the upper assembly 102 and the second cross member 132 of the upper assembly 102 via a first board pivot joint 412 and a second board pivot joint (not shown). The first board pivot joint 412 and the second board pivot joint (not shown) can include the same components and only the first board pivot joint 412 will be discussed in detail. FIG. 9 depicts an enlarged view of the first board pivot joint 412, illustrating that the joint 412 includes an upper pivot portion 414 that is affixed to the platform 402 forming a part thereof having a pivot hole 416 extending perpendicularly therethrough, and a lower pivot portion 418 having a pivot hole (not shown) extending perpendicularly therethrough that is removably coupled to the first cross member 130 via removable attachment means 420, e.g., nuts, bolts, pins, washers, spring-loaded engagement mechanisms, and the like. The second board pivot joint (not shown) is similarly constructed and removably coupled to the second cross member 132 via removably attachment means 420.

The first board pivot joint 412 includes a first board bushing (not shown) extending through the pivot holes of the upper and lower pivot portions 414 and 418, a pivot bolt 422 and a pivot nut (not shown). The first board bushing is oriented and configured to rotatably support the pivot bolt 422 axially inserted therethrough. The pivot bolt 422 has a distal portion (not shown) with a radial edge that abuts the upper pivot portion 414 and an oppositely disposed proximal threaded portion (not shown) that is axially inserted through the first board bushing that transverses the upper and lower portions 414 and 418, so as to threadably engage the pivot nut thereby rotatably securing the first pivot portion 414 to the second pivot portion 418. The second board pivot joint (not shown) is similarly constructed for coupling to the second cross member 132.

It will be appreciated that the first lower pivot joint 412 and the second lower pivot joint cooperatively enable rotation of the snow board assembly 400 about the first axis 126 relative to the upper frame assembly 102 and the lower frame assembly 104. The snowboard assembly 400 may also include a cage component 424 that extends from and surrounds the exercise device 100 so as to provide stability to the user on the snowboard platform 402. In such embodiments, the cage component 424 may comprise similar tubular construction of the upper and lower platform assemblies 102 and 104, be of smaller construction so at to be inserted therein, e.g., into the ends 238 and 240 of the first cross member 234 of the lower frame assembly 104 and the ends 242 and 244 of the second cross member 236 of the lower frame assembly 104, be capable of insertion into the posts 318 and 320, or the like.

In one example operation, a user of the apparatus 100 stands on the first pedal platform 110 and the second pedal platform 112. The user then applies a balancing force by grasping the grips 362 the first ski attachment posts 118 and 120. The user then applies a lateral force in a direction around the first axis, thereby rotating the upper frame assembly 102 relative to the lower frame assembly 104. In reaction to the application of the lateral force, the elastic members 114 in the direction of the lateral force collapse, while the elastic members 114 on the opposite side expand, so as to exert a countervailing force to the applied lateral force. The user then shifts the application to the opposite direction, thereby reversing the actions of the elastic members 114 so as to provide countervailing force to the new lateral direction. The elastic members 114 then assist the user in returning the pedal platforms 110 and 112 to a level position relative to the lower assembly 104 before repeating the actions to simulate the motions of downhill skiing. To increase the tension, i.e., resistance felt by the user, the user may tighten the tension adjustment member 346 applying the brake pads first brake pad 348 and the second brake pad 350 to the plate member 342 so as to make the lateral movement more difficult based upon the friction applied by the pads 348 and 350 to the plate member 342. The user may further perform repetitions only to one side, so as to strengthen the muscles involved in either right or left turns. Thus the user shifts to the right on the platforms 110 and 112 and the elastic members 114 facilitate returning to a level position, i.e., the user need not proceed laterally to the left unless another force is exerted in that direction. Thereafter, the user may continue to shift only to the right, allowing the elastic members 114 to return the user to the upright position wherein the upper frame assembly 102 is level with respect to the lower frame assembly 104.

In another example operation of the exercise device 100, a user stands on the platform 402 of the snowboard assembly 400 facing either the first side member 294 or the second side member 296 of the lower frame assembly 104. The user then grasps the cage 424 for balance and begins shifting weight back and forth, performing the same action set forth above with respect to the pedal platforms 110 and 112. It will be appreciated that in such an example, the user applies a forward and backward motion relative to their position, as opposed to the direct lateral motion of the pedal platforms 110 and 112. In such an example operation, the user applies a lateral force around the first axis 126 and receives countervailing resistance from the elastic members 114. The elastic members 114 further assist in returning the user, and thus the platform 402 to a level position, wherein the process may be repeated to simulate the actions of downhill snowboarding.

The user may also increase the tension on the plate member 342 via the tension adjustment member 346 of the brake component 116 so as require additional effort on the part of the user.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An exercise apparatus, comprising:

an upper frame assembly comprising a first vertical member, a second vertical member, and a center member perpendicularly coupled to the first vertical member and the second vertical member;

a lower frame assembly operatively coupled to the first vertical member and the second vertical member of the upper frame assembly at a first lower pivot and a second lower pivot allowing lateral movement of the upper frame assembly relative to the lower frame assembly, the lower frame assembly having a width greater than a width of the upper frame assembly;

a first pedal platform pivotally attached to the upper frame assembly at a first pivot and a second pivot so as to provide lateral movement relative to the upper frame assembly;

a second pedal platform pivotally attached to the upper frame assembly at a first pivot and a second pivot and parallel to the first pedal platform so as to provide lateral movement relative to the upper frame assembly; and a first plurality of elastic members operatively coupled to a first side of the center member of the upper frame assembly and a second side member of the lower frame assembly so as to provide resistance and stability of the upper frame assembly relative to the lower frame assembly, wherein the first side of the center member to which the first plurality of elastic members is coupled faces opposite the second side member of the lower frame assembly; and a second plurality of elastic members operatively coupled to a second side of the center member of the upper frame assembly and a first side member of the lower frame assembly so as to provide resistance and stability of the upper frame assembly relative to the lower frame assembly, wherein the second side of the center member to which the second plurality of elastic members is coupled faces opposite the first side member of the lower frame assembly.

2. The exercise apparatus of claim 1, further comprising a brake assembly located at at least one of the first and second lower pivots of the upper frame assembly and the lower frame assembly providing resistance therebetween.

3. The exercise apparatus of claim 1, further comprising at least one angle adjusting component removably coupled to at least one end of the lower frame assembly.

4. The exercise apparatus of claim 1, wherein a top of the first pedal platform is located below the first and second pivots associated therewith, and wherein a top of the second pedal platform is located below the first and second pivots associated therewith.

5. The exercise apparatus of claim 1, wherein at least one of the elastic members comprises a spring, a rubber band, a tension pulley, a magnetic resistance member or a fluid resistance member.

6. The exercise apparatus of claim 1, further comprising at least one post coupled to the lower frame assembly, the at least one post configured to receive a pole attachment therein.

7. A skiing exercise apparatus, comprising:

an upper frame assembly comprising a first cross member, a second cross member, a first side member, a second side member, a third side member, a fourth side member, a first vertical member, a second vertical member, and a center member perpendicularly coupled to the first vertical member and the second vertical member;

a lower frame assembly operatively coupled to the first vertical member and the second vertical member of the upper frame assembly at a first lower pivot and a second lower pivot allowing lateral movement of the upper frame assembly relative to the lower frame assembly, the lower frame assembly having a width greater than a width of the upper frame assembly;

a first pedal platform pivotally attached to the first side member and the second side member of the upper frame assembly at a first pivot and a second pivot so as to provide lateral movement relative to the upper frame assembly;

a second pedal platform pivotally attached to the third side member and the fourth side member of the upper frame assembly at a first pivot and a second pivot and parallel to the first pedal platform so as to provide lateral movement relative to the upper frame assembly; and a first plurality of elastic members operatively coupled to the center member of the upper frame assembly and a second side member of the lower frame assembly so as to provide resistance and stability of the upper frame assembly relative to the lower frame assembly; and a second plurality of elastic members operatively coupled to the center member of the upper frame assembly and a first side member of the lower frame assembly so as to provide resistance and stability of the upper frame assembly relative to the lower frame assembly.

8. The skiing exercise apparatus of claim 7, further comprising at least one post coupled to the lower frame assembly, the at least one post configured to receive a pole attachment therein.

9. The skiing exercise apparatus of claim 7, wherein a top of the first pedal platform is located below the first and second pivots associated therewith, and wherein a top of the second pedal platform is located below the first and second pivots associated therewith.

10. The skiing exercise apparatus of claim 9, further comprising a brake assembly located at at least one of the first and second lower pivots of the upper frame assembly and the lower frame assembly providing resistance therebetween.

11. The skiing exercise apparatus of claim 7, further comprising at least one angle adjusting component removably coupled to at least one end of the lower frame assembly.

12. The skiing exercise apparatus of claim 10, wherein the brake assembly further comprises at least one tension adjustment member, the tension adjustment member operable to increase or decrease the provided resistance.

* * * * *